US008542000B1

(12) United States Patent
Youssefi

(10) Patent No.: US 8,542,000 B1
(45) **Date of Patent: *Sep. 24, 2013**

(54) CURVATURE COMPENSATED BAND-GAP DESIGN

(71) Applicant: SanDisk Technologies Inc., Plano, TX (US)

(72) Inventor: Behdad Youssefi, Santa Clara, CA (US)

(73) Assignee: SanDisk Technologies Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/673,201

(22) Filed: Nov. 9, 2012

Related U.S. Application Data

(63) Continuation of application No. 13/423,427, filed on Mar. 19, 2012, now abandoned.

(51) Int. Cl.
*G05F 3/16* (2006.01)
*G05F 3/20* (2006.01)

(52) U.S. Cl.
USPC ..... 323/313

(58) Field of Classification Search
USPC ..... 323/313–316
See application file for complete search history.

(56) References Cited

U.S. PATENT DOCUMENTS

| | | | | |
|---|---|---|---|---|
| 5,532,962 | A | 7/1996 | Auclair et al. | |
| 6,181,191 | B1 * | 1/2001 | Paschal | 327/513 |
| 6,560,152 | B1 | 5/2003 | Cernea | |
| 6,735,546 | B2 | 5/2004 | Scheuerlein | |
| 6,778,008 | B2 * | 8/2004 | Andrews | 327/543 |
| 6,801,454 | B2 | 10/2004 | Wang et al. | |
| 6,839,281 | B2 | 1/2005 | Chen et al. | |
| 6,954,394 | B2 | 10/2005 | Knall et al. | |
| 6,956,516 | B2 | 10/2005 | Furuichi | |
| 7,057,958 | B2 | 6/2006 | So et al. | |
| 7,199,646 | B1 * | 4/2007 | Zupcau et al. | 327/539 |
| 7,236,023 | B2 | 6/2007 | Thorp et al. | |
| 7,269,092 | B1 | 9/2007 | Miwa | |
| 7,277,343 | B1 | 10/2007 | So et al. | |
| 7,283,414 | B1 | 10/2007 | So et al. | |
| 7,342,831 | B2 | 3/2008 | Mokhlesi et al. | |
| 7,391,650 | B2 | 6/2008 | Mokhlesi et al. | |
| 7,646,659 | B2 | 1/2010 | Sako | |
| 7,889,575 | B2 | 2/2011 | Wang et al. | |

(Continued)

FOREIGN PATENT DOCUMENTS

CN 100 428 105 10/2008

OTHER PUBLICATIONS

Malcovati et al, "Curvature Compensated BiCMOS Bandgap with I V Supply Voltage," Proceedings of the 26th European Solid-State Circuits Conference, IEEE, Sep. 19-21, 2000, 4 pages.

(Continued)

*Primary Examiner* — Jue Zhang
(74) *Attorney, Agent, or Firm* — Davis Wright Tremaine LLP

(57) ABSTRACT

A bandgap reference circuit is compensated for temperature dependent curvature in its output. A voltage across a diode with a fixed current is subtracted from a voltage across a diode with a proportional to absolute temperature (PTAT) current. The resultant voltage is then magnified and added to a PTAT voltage and a diode's voltage that has a complementary-to-absolute temperature (CTAT) characteristic, resulting in a curvature corrected bandgap voltage.

5 Claims, 4 Drawing Sheets

(56) References Cited

U.S. PATENT DOCUMENTS

| | | | | |
|---|---|---|---|---|
| 8,004,917 | B2 | 8/2011 | Pan et al. | |
| 2007/0052473 | A1 | 3/2007 | McLeod | |
| 2007/0286004 | A1 | 12/2007 | Kim et al. | |
| 2008/0007244 | A1* | 1/2008 | Draxelmayr | 323/316 |
| 2008/0018316 | A1 | 1/2008 | Chang et al. | |
| 2008/0031066 | A1 | 2/2008 | Nandi | |
| 2008/0094908 | A1 | 4/2008 | Mokhlesi et al. | |
| 2008/0094930 | A1 | 4/2008 | Mokhlesi | |
| 2008/0158947 | A1 | 7/2008 | Li et al. | |
| 2008/0158970 | A1 | 7/2008 | Sekar et al. | |
| 2008/0158975 | A1 | 7/2008 | Sekar et al. | |
| 2008/0159000 | A1 | 7/2008 | Li et al. | |
| 2008/0238530 | A1 | 10/2008 | Ito et al. | |
| 2008/0247253 | A1 | 10/2008 | Nguyen et al. | |
| 2008/0247254 | A1 | 10/2008 | Nguyen et al. | |
| 2009/0003109 | A1 | 1/2009 | Thorp et al. | |
| 2009/0003110 | A1 | 1/2009 | Thorp et al. | |
| 2009/0091311 | A1 | 4/2009 | Kang | |
| 2009/0146730 | A1 | 6/2009 | Chen | |
| 2009/0296465 | A1 | 12/2009 | Wang et al. | |
| 2010/0074033 | A1 | 3/2010 | Pan et al. | |
| 2010/0134180 | A1* | 6/2010 | Smith et al. | 327/539 |

OTHER PUBLICATIONS

Mok et al, "Design Considerations of Recent Low-voltage Low-Temperature-Coefficient CMOS Bandgap Voltage Reference," Proceedings of the Custom integrated Circuits Conference, Nov. 22, 2004, IEEE, 8 pages.

Gunawan et al, "A Curvature-Corrected Low-Voltage Bandgap Reference," IEEE Journal of Solid-State Circuits, vol. 28, No. 6, Jun. 1993, pp. 667-670.

Tao et al, "Low voltage Bandgap Reference with Closed Curvature Compensation," Journal of Semiconductors, Mar. 2009, pp. 035006-1-1035006-4.

Ning et al, "A Low Drift Curvature-compensated Bandgap Reference with Trimming Resistive Circuit," J. Zhejiang Univ-Sci C, Comput & Electron, 2011, 12(8), pp. 698-706.

Guan et al, "A 3 V 110 μW 3.1 ppm/C Curvature-compensated CMOS Bandgap Reference," Analog Integr Circ Sig Process, 2010, vol. 62, pp. 62:113-62:119.

* cited by examiner

CURVATURE COMPENSATED BAND-GAP DESIGN

CROSS-REFERENCE TO RELATED APPLICATION

This application is a continuation of U.S. patent application Ser. No. 13/423,427 filed Mar. 19, 2012, which application is incorporated in its entirety by this reference.

FIELD OF THE INVENTION

This invention pertains generally to the field of bandgap voltage reference circuit and, more particularly, to compensating for the temperature dependence bandgap circuits.

BACKGROUND

There is often a need in integrated circuits to have a reliable source for a reference voltage. One widely used voltage reference circuit is the bandgap voltage reference. The bandgap voltage reference is generated by the combination of a Proportional to Absolute Temperature (PTAT) element and a Complementary to Absolute Temperature (CTAT) element. The voltage difference between two diodes is used to generate a PTAT current in a first resistor. The PTAT current typically is used to generate a voltage in a second resistor, which is then added to the voltage of one of the diodes. The voltage across a diode operated with the PTAT current is the CTAT element that decreases with increasing temperature. If the ratio between the first and second resistor is chosen properly, the first order effects of the temperature can be largely cancelled out, providing a more or less constant voltage of about 1.2-1.3 V, depending on the particular technology.

Since bandgap circuits are often used to provide an accurate, temperature independent reference voltage, it is important to minimize the voltage and temperature related variations over the likely temperature range over which the bandgap circuit will be operated. One usage of bandgap circuits is as a peripheral element on non-volatile memory circuits, such as flash memories, to provide the base value from which the various operating voltages used on the circuit are derived. There are various ways to make bandgap circuits less prone to temperature dependent variations; however, this is typically made more process limited, and is difficult in applications where the bandgap circuit is a peripheral element, since it will share the same substrate and power supply with the rest of the circuit and will often be allowed only a relatively small amount of the total device's area.

SUMMARY OF THE INVENTION

A circuit for providing a reference voltage is presented. The circuit includes a first diode connected between a proportional to absolute temperature current source and ground and a first resistance connected between the first diode and the proportional to absolute temperature current source. A first opamp has a first input connected to a node between the first resistance and the first diode, an output connected to the gate of a first transistor connected between a high voltage level and ground. The first transistor is connected to ground through a second resistance and the second input of the first opamp is connected to a node between the first transistor and the second resistance. A second diode is connected between ground and the high voltage level, where the second diode is connected to the voltage level by a first and a second leg. The first leg includes a second transistor whose gate is connected to receive the output of the first opamp. The second leg includes a third transistor connected in series with a resistive voltage divider, where the resistive voltage divider is connected between the second diode and the third transistor. A second opamp has an output connected to the gate of the third transistor, a first input connected to a node between the proportional to absolute temperature current source and the first resistance, and a second input connected to a node of the resistive voltage divider. The reference voltage is provided from a node between the third transistor and the resistive voltage divider.

Various aspects, advantages, features and embodiments of the present invention are included in the following description of exemplary examples thereof, which description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

BRIEF DESCRIPTION OF THE DRAWINGS

The various aspects and features of the present invention may be better understood by examining the following figures, in which.

DETAILED DESCRIPTION

Figure 1:
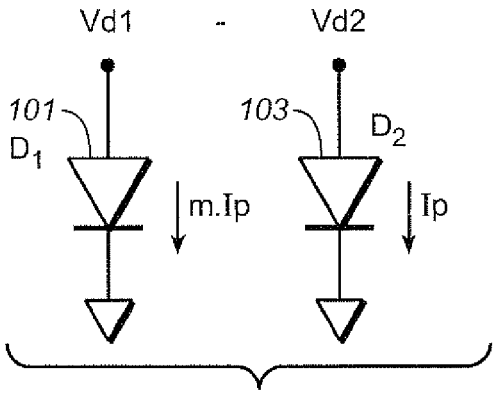
FIG. 1 schematically illustrates taking the voltage difference between two diodes.

The techniques presented here can be employed to overcome some of the limitations of the prior art and can effectively help with the cancelation of band-gap curvature with relative process insensitivity. If a voltage across a diode with fixed current is subtracted from a voltage across a diode with current proportional to absolute temperature (PTAT), a nonlinear voltage in temperature is derived. This voltage is then divided by a resistor to generate a nonlinear current which can be used to cancel out curvature of band gap current. This current is then flown through a resistor to generate a curvature corrected band-gap voltage. In the design presented here, a voltage across a diode with fixed current is subtracted from a voltage across a diode with current proportional to absolute temperature (PTAT). The resulting voltage is then magnified and added to a PTAT voltage and a diode's voltage which has complementary-to-absolute-temperature (CTAT) characteristic which results in a curvature corrected band-gap voltage.

As addition of PTAT and CTAT voltage and curvature correction is done all at once in this arrangement, the number of op-amps and current mirrors needed in this design is considerably less than other comparable designs, which makes it simpler and less susceptible to process variations. In addition, as the band-gap current is passed through a diode, as opposed to a resistor, this design is far less susceptible to absolute value and temperature coefficient of resistors. Moreover, with the addition of an extra resistor in the PTAT chain, this design enjoys an added flexibility of choosing amplification of PTAT and nonlinear voltage independently of one another. This makes trimming the band-gap voltage at one temperature possible.

One use of a bandgap circuit is as a peripheral element on a circuit, such as on a memory chip for providing a reference voltage from which various operating voltages can be generated, such as the wordline bias voltage $V_{WL}$ for reading a (in this case) floating gate memory cell in a NAND type architecture. This application of a bandgap circuit is described further in U.S. Pat. No. 7,889,575. More detail and examples related to temperature related operation, mainly in the context of memory devices, and uses where bandgap reference values can be used to generate operating voltages can be found in the following US patents and publications: U.S. Pat. Nos. 6,735,546; 6,954,394; 7,057,958; 7,236,023; 7,283,414; 7,277,343; 6,560,152; 6,839,281; 6,801,454; 7,269,092; 7,391,650; 7,342,831; 2008/0031066A1; 2008/0159000A1; 2008/0158947A1; 2008/0158970A1; 2008/0158975A1; 2009/0003110A1; 2009/0003109A1; US 2008/0094908; 2008/0094930A1; 2008/0247254A1; and US 2008/0247253A1. Another example of temperature compensation for a bandgap voltage generation circuit and its use in a non-volatile memory is found in US2010/0074033A1. Along with these temperature related aspects, the generation of various operating voltages from reference values is presented in U.S. Pat. No. 5,532,962. The techniques presented here can be applied for the various base reference voltages described in these references as well as other applications where bandgap circuits are employed, but being particularly advantageous when used as a peripheral element on a larger circuit where the design, process, technology, and/or product limitations of the larger circuit can negatively affect the bandgap reference element. In addition to the main example of a non-volatile memory, these techniques also have application where high voltage biases are needed, such as when a bandgap voltage is used as the reference voltage for charge pump regulation and the high voltage output from the charge pump is generated by multiplying of the bandgap voltage. Various process and device limitations require an accurate voltage level be provided without too much variation so as to prevent oxide/junction break downs or punch through effect on the devices. In this application, any temperature variation of the bandgap voltage would be multiplied in forming the high voltage biases. Consequently, the minimizing the temperature variation of the bandgap voltage is important for this type of application as well.

In a conventional hand-gap reference generator, the circuit adds a Proportional-to-Absolute-Temperature (PTAT) voltage, which is linear in the temperature, to a voltage drop across a diode which has Complimentary-to-Absolute-Temperature (CTAT) characteristics (and is consequently not linear in temperature) to get a voltage with zero first-order Temperature Coefficient (TC). PTAT voltages can be generated by subtracting voltage drop across two diodes with different current densities. For example, referring to FIG. 1, this shows a diode $D_2$ 103 with a current density $I_p$ and a diode $D_1$ 101 with a current density $mI_p$, so that the ratio of these two currents is m. If the voltage drops across these two are subtracted, this gives the relationship:

$$V_{D1}-V_{D2}=V_T\ln(m),$$

providing the desired PTAT behavior. However, because of the nonlinearity of a diode's voltage with temperature, bandgap references always have some residual finite curvature with respect to temperature.

The issue of curvature is relevant for several reasons. The temperature dependent curvature of the band-gap can introduce an error in the reference voltage at mid temperatures, even with zero first order temperature coefficient (TCO). For example, in a data converter design or any other circuits requiring an accurate reference voltage, this sets a limit on their accuracy which lowers Effective-number-of-bits (ENOB), since if the variation is large enough it will be greater the change in some number of least significant bits. In the case where the band-gap circuit is used to generate control gate read voltages ($V_{CGRV}$), as the reference value is scaled up to provide these voltages, the error voltage could be as high as 50 mV, for example, at room temperature even with perfect first order TCO.

For example, in a fairly conventional bandgap reference circuit, the error for the output of the circuit over a temperature range −40 C to 100 C is as much as 10 mV. For use in reading a memory level with a threshold voltage of 6V, this is error is scaled up by a factor of about 6V/1.2V=5, so that the error in the read voltage error could be up to 50 mV. In a multistate memory of say, 3-bits, where 8 state distributions need to fit into a window of 6 volts, this can be non-negligible.

Figure 2:
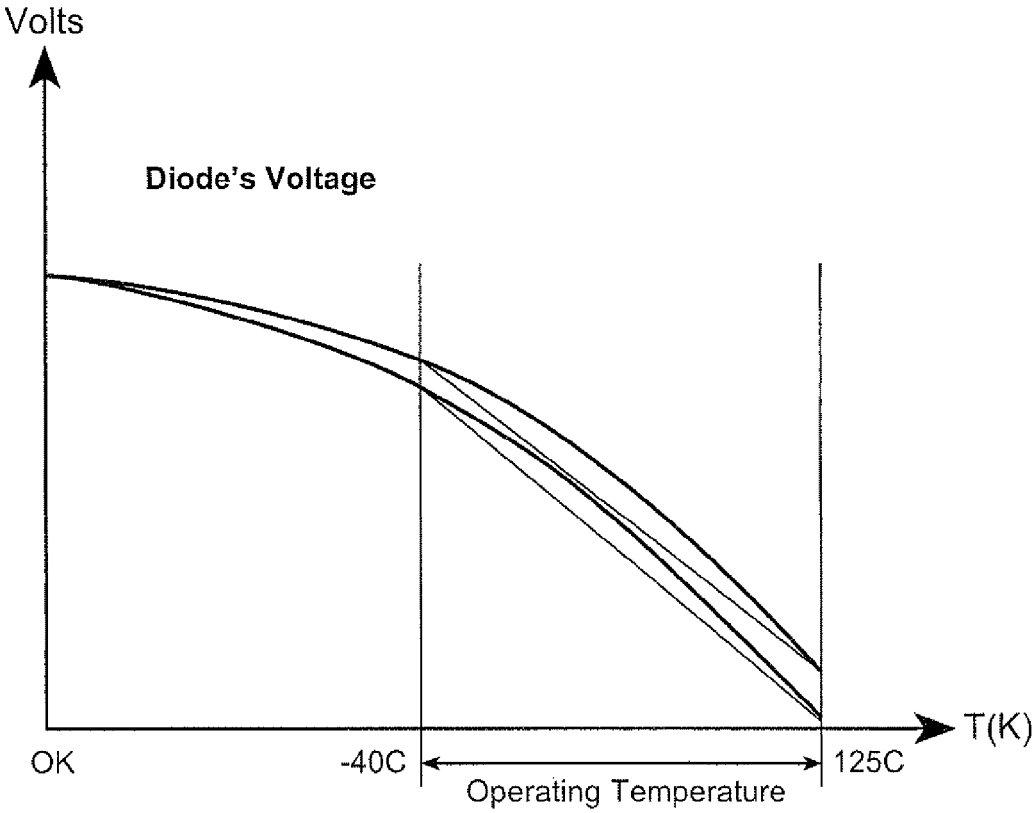
FIG. 2 shows voltages for two different diodes with different curvatures in temperature.

Another reason why curvature is important has to do with the fact that variation in curvature also varies the first order TCO. As a result, a different positive TCO is needed to compensate for diode's negative TCO. Referring to FIG. 2, this shows the voltage versus temperature for two diodes with different curvatures in temperature. In FIG. 2, the broken line is a linearization of the variation over the operating temperature range. This variation is a cause of variation in the bandgap reference voltage, a consequence of which is that a manufacturer cannot trim all dies at one voltage and get a zero TCO. In a fairly typical case, the variations between different dies can be ~30 mV.

A number of prior art schemes have been proposed to compensate for the curvature of band-gap references, but they are either very complicated, and thus more susceptible to process variations, or inherently incapable of removing all nonlinearities. In addition, some of these schemes are dependent on the absolute value of resistors, which makes them less useful when the absolute value of resistor is not accurately known before fabrication or when resistors themselves have large temperature coefficients. The arrangement described here is both relatively simple, and if trimmed correctly, capable of removing all nonlinearities. Additionally, it is relatively insensitive to temperature coefficient and absolute value of resistors.

By way of background, the voltage across diode is given by $$V_D = V_T\ln\left(\frac{I_D}{I_s}\right)$$

where $I_D$ is the current through the diode, $V_T$ is the thermal voltage, and $I_s$ is the saturation current, where $$I_s = bT^{4+m}e^{\frac{-E_s}{V_T}}$$

m is a process parameter, and $E_g$ is the band gap of silicon.

Combining these gives:

$$V_D=V_T\ln(I_D)-V_T\ln(b)-(4+m)V_T\ln(T)+E_g.$$

Figure 3:
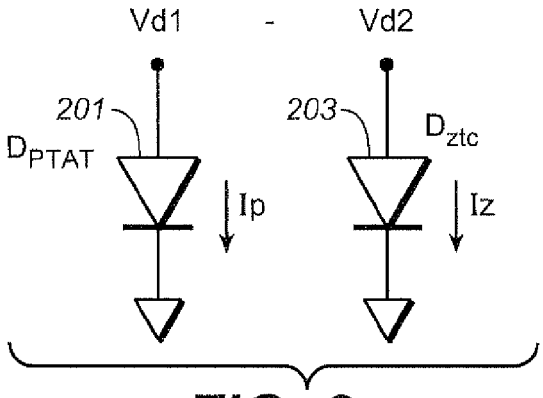
FIG. 3 schematically illustrates taking the voltage difference between a diode with a PTAT current and a diode with a constant current.

The $(4+m)V_T$ term is non-linear in temperature. Similarly to FIG. 1, FIG. 3 shows a pair of diodes $D_{ptat}$ 201 with a PTAT current and $D_{ztc}$ 203 with a current with no temperature coefficient. For the first of these, the current and voltage are:

$$I_D=I_{ptat}=\alpha T\Rightarrow V_{D_{ptat}}=V_T\ln(\alpha/b)-(3+m)V_T\ln(T)+E_g$$

For the second the relations are:

$$I_D=I_z\Rightarrow V_D=V_T\ln(I_z/b)-(4+m)V_T\ln(T)+E_g$$

If the voltage drop across the diode D 203 with constant current is subtracted from that of $D_{ptat}$ 201 with a PTAT current, the nonlinear term $V_T\ln(T)$ can be achieved:

$$V_{D_{ptat}}-V_{D_{ztc}}=V_T\ln(\alpha/I_z)+V_T\ln(T).$$

The last term with the non-linearity in temperature can be cancelled by choice of the correct coefficient. This can then be used to produce a bandgap reference level of:

$$BGR=V_D+\beta(V_{D_{ptat}}-V_{D_{ztc}})=E_g,$$

where β is the ratio of voltage divider where the output is taken. (For example, in the arrangement of FIGS. 4 and 5, this is Rz/Rp1.)

Figure 6:
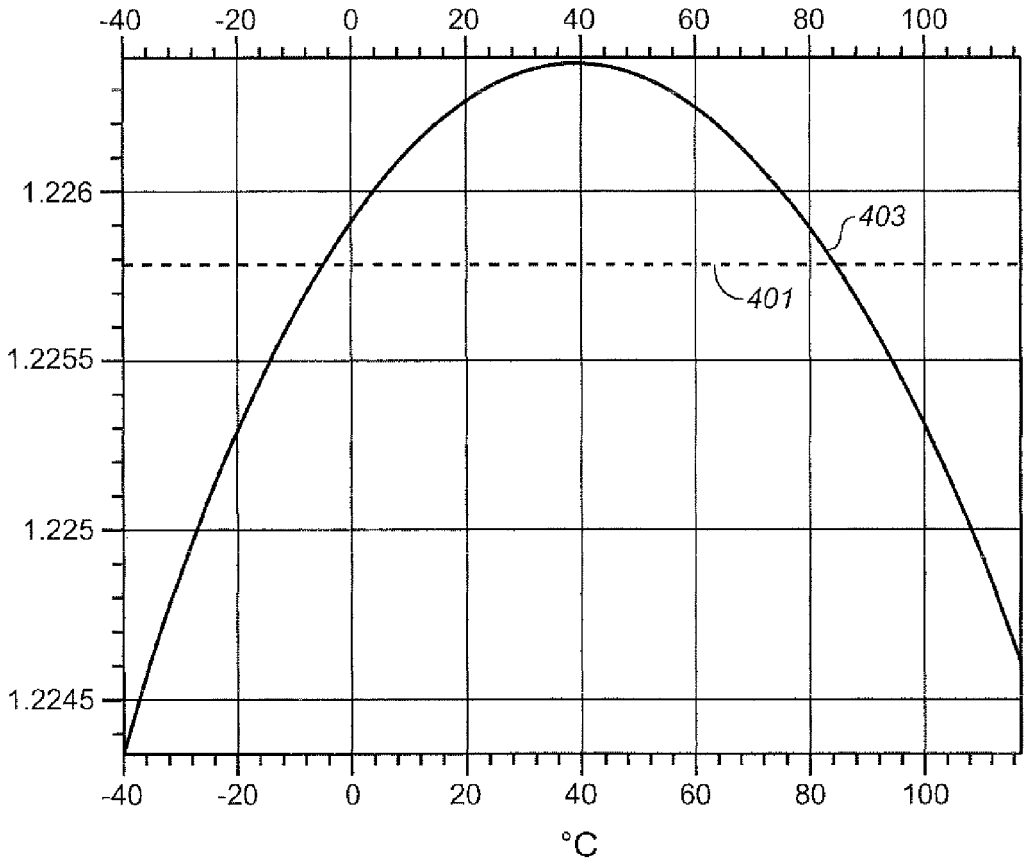
FIG. 6 shows a comparison between the temperature variation of a conventional bandgap reference circuit and of an implementation of output of the exemplary embodiment.

FIGS. 6 and 7 show exemplary embodiments for a bandgap circuit that can be used to achieve this sort of curvature compensation. One of the practical problems in implementing this arrangement is that, in practice, the difference in diode sizes cannot not be made too great within a given circuit. Consequently, by just relying upon the relative sizing on of the two diodes restricts the value of $(V_{D_{ptat}}-V_{D_{ztc}})$ to be a small value as a practical matter. This can make it more susceptible to noise and amplifier's offset and generally harder to adjust the relative values. In an aspect of the bandgap reference circuits presented here, a resistance (such as $R_{p2}$ of FIG. 4) is added to achieve a larger value for this difference. This serves to make the effective relative area of the diode more, while keeping the actual relative area small and thus overcoming the problem of having diodes of quite different sizes. The arrangement presented here also makes the output of the circuit dependent on the ratio of resistances in the circuit, rather than the absolute value of a resistance, making the circuit less sensitive to process variations and temperature dependencies in the resistances.

Figure 4:
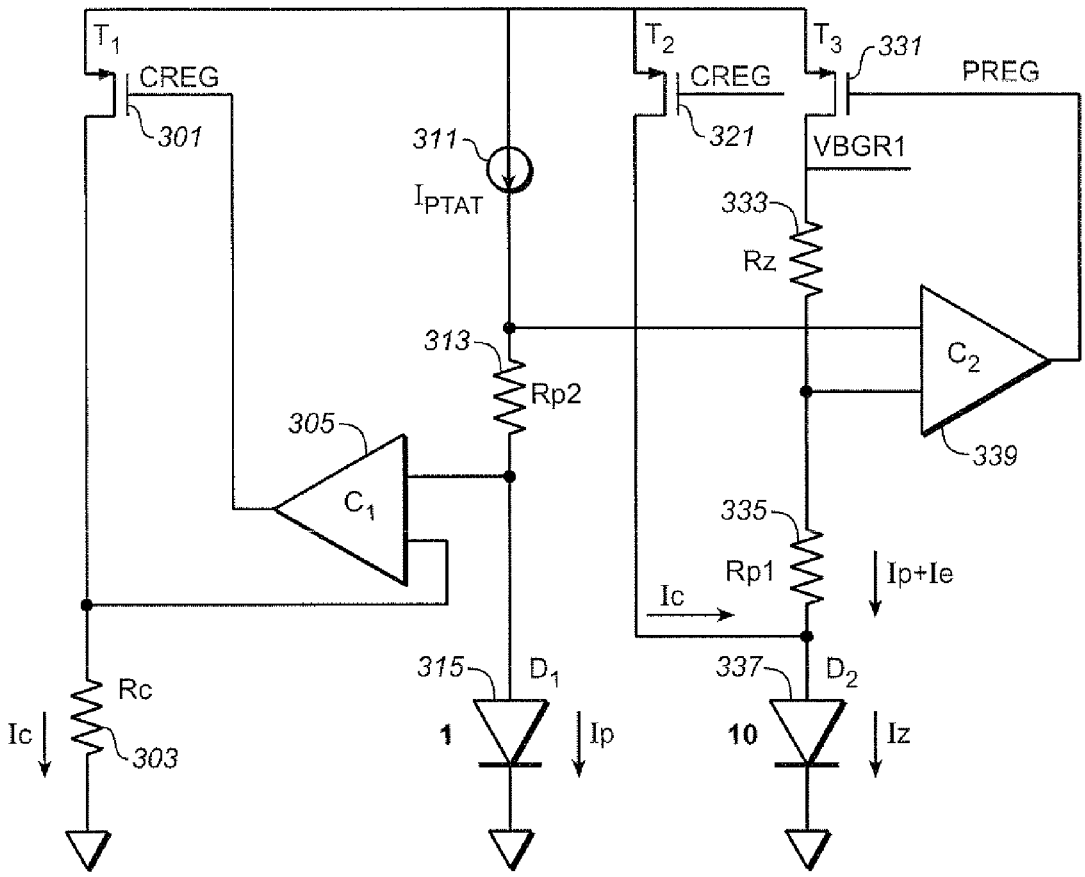
FIG. 4 is a schematic of an exemplary embodiment of a bandgap reference voltage circuit.

FIG. 4 is an exemplary embodiment of a schematic for a bandgap reference circuit. The output of the circuit is at VBGR1 and the elements are connected by the high (Vdd) and low (ground) voltage levels of the chip. Starting on the left is a portion to generate a complimentary to absolute temperature (CTAT) current Ic. This has a first leg of the circuit including a transistor T1 301 connected between the high voltage level and ground through the resistor Rc 303, where the current flowing through is Ic. The gate of T1 301 is controlled by the output CREG of opamp C1 305, whose first input is from a node between T1 301 and Rc 303. A second leg includes a PTAT current source, providing a current Ip, connected in series with the resistance Rp2 313 and the diode D1 315. The second input of the opamp C1 305 is taken from a node between Rp2 313 and D1 315.

A second diode D2 337 is fed by the combination of two legs. The first provides has a transistor T2 321 connected between the high voltage level and D2 337, where the gate of T2 321 is controlled by the output CREG of C1 305, so that it will provide a current Ic into D2 337. A current of (Ip+Ie), where Ie represents the portion for the error (the non-linear term) current, is also supplied to D2 337 by the series combination of T3 331, Rz 333, and Rp1 335. The combined current through D2 337 is then Iz. The gate of T3 331 is controlled by the output PREG of opamp C2 339, which has a first input connect to a node between the Iptat current source 311 and Rp2 313 and has a second input connected to a node between Rz 333 and Rp1 335. The output of the circuit VBGR1 is then taken from between Rz 333 and T3 331.

In FIG. 4, the numbers 1 and 10 that are respectively next to D1 315 and D2 337 indicate the relative sizes of these diodes. As discussed above, it is desirable to have a larger value for the difference $(V_{D_{ptat}}-V_{D_{ztc}})=(V_{D1}-V_{D2})$, which can be achieved by increasing the size differential between the diodes; however, to go much beyond this factor of 10 is generally not practically achievable. The inclusion of the resistance Rp2 313 above the diode D1 313 functionally acts as if the diode D1 where smaller, helping to increase the difference.

Figure 5:
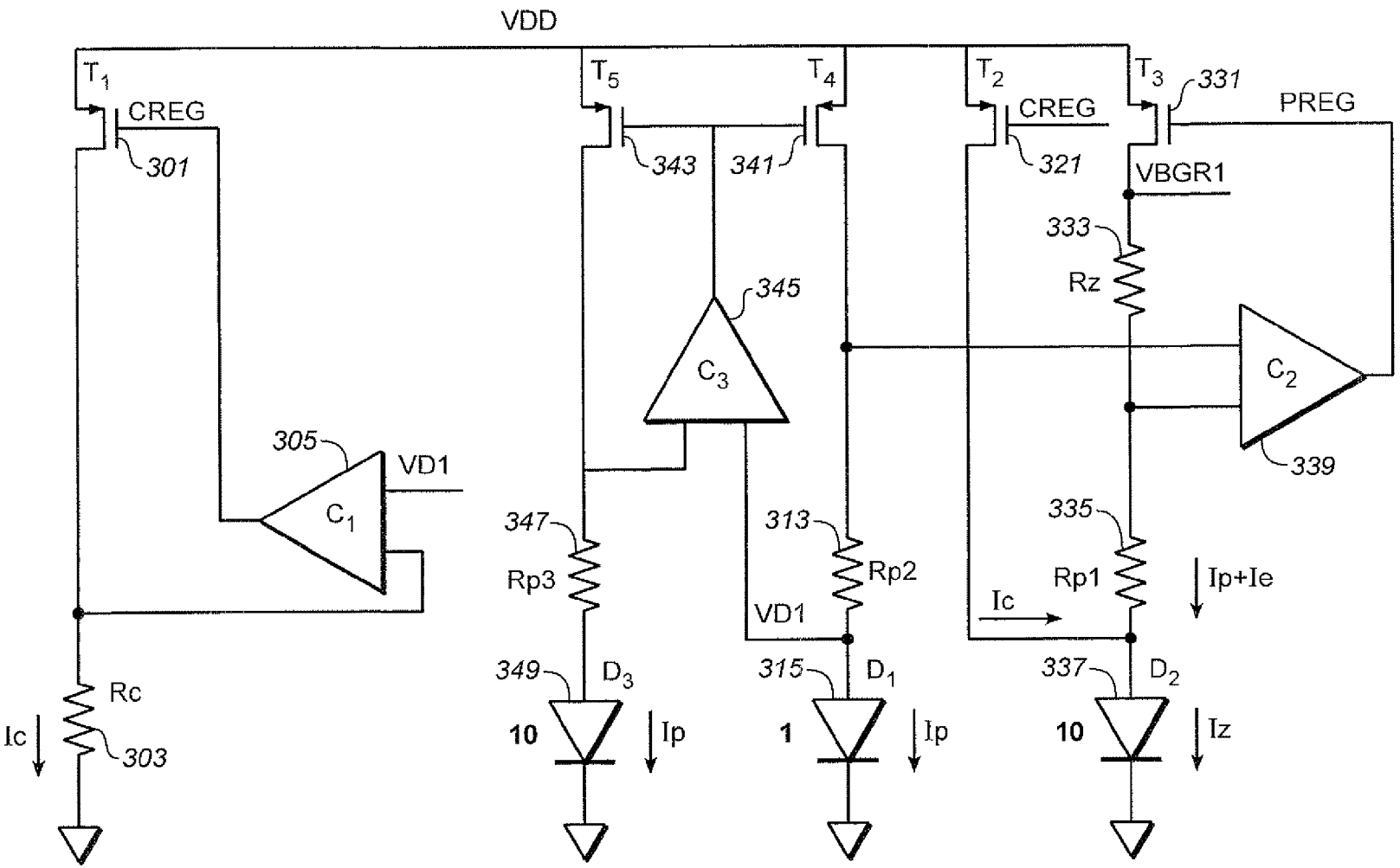
FIG. 5 is a version of FIG. 4 with more detail on a PTAT current source.

FIG. 5 adds some detail for a specific embodiment of the PTAT current source 311 $I_{PTAT}$ 311 of FIG. 4. In addition to the elements shown in FIG. 4, a transistor T4 341 is connected between Vdd and Rp2 313 to supply the PTAT current Ip into D1 315. The gate of T4 341 is controlled by the output of opamp C3 345. A first input of the opamp is taken from the same node (here marked VD1) between Rp2 313 and D1 315 as used as an input for C1 305. The output of C3 345 is also connected to control a transistor T5 343 that is connected between Vdd and ground through first a resistance Rp3 347 and a diode D3 349 that is sized the same as D2 337, through which again flows Ip. The second input of C3 345 is taken from a node between T5 343 and Rp3 347.

The output of the circuit, VBGR1, can be found by looking at the currents through D1 315 and D2 337:

$$\begin{cases} I_{D1}=I_z\Rightarrow V_{D1}=V_T\ln(I_z/b)-(4+m)V_T\ln(T)+E_g \\ I_{D2}=I_p=\alpha T\Rightarrow V_{D2}=V_T\ln(\alpha/b)-(3+m)V_T\ln(T)+E_g \end{cases},$$

Taking the difference gives:

$$V_{D1}-V_{D2}=V_T\ln(\alpha/I_z)+V_T\ln(T).$$

From this follows:

$$I_{Rz}=\frac{V_{D2}+I_p\cdot R_{p2}-V_{D3}}{R_{p1}}=\frac{V_T}{R_{p1}}\ln\left(\frac{\alpha\cdot n}{I_z}\right)+\frac{V_T}{R_{p1}}\ln(T)+\frac{R_{p2}}{R_{p1}}\alpha\cdot T$$

and $$V_{BGR1}=V_T\cdot\left[\frac{R_Z}{R_{p1}}\ln\left(\frac{\alpha\cdot n}{I_{zic}}\right)+\frac{\alpha\cdot R_{p2}}{K/q}\left(\frac{R_Z}{R_{p1}}+1\right)+\ln(\alpha/b)\right]+\left[\frac{R_Z}{R_{p1}}-(3+m)\right]\cdot V_T\cdot\ln(T)+E_g,$$

to give the value of VBGR1.

FIG. 6 shows the temperature variation of an implementation of the output of the exemplary embodiment over the same range of −40 C to 120 C. This is shown at 401, where the output typical of a conventional BGR circuit is shown at 403. As shown, the variation 401 of the exemplary embodiment over this range of −40 C to 120 C is noticeably flatter, having a variation of ~15 μV, as compared to ~2 mV at 403 for the conventional design. Consequently, the band-gap reference generator described above can provide curvature compensation in a relatively simple scheme that makes it less susceptible to process variations. As the curvature of a band-gap reference circuit is process dependent, the value of the circuit's voltage varies with process as well. Thus, when the curvature is perfectly compensated for, the value of BGR voltage will be independent of process and only a function of physical properties of silicon. This makes trimming the bandgap reference at one temperature possible.

Although the invention has been described with reference to particular embodiments, the description is only an example of the invention's application and should not be taken as a limitation. Consequently, various adaptations and combinations of features of the embodiments disclosed are within the scope of the invention as encompassed by the following claims.

It is claimed:

1. A circuit for providing a reference voltage, comprising:

a first diode connected between a proportional to absolute temperature current source and ground;

a first resistance connected between the first diode and the proportional to absolute temperature current source;

a first opamp having a first input connected to a node between the first resistance and the first diode, an output connected to the gate of a first transistor connected between a high voltage level and ground, wherein the first transistor is connected to ground though a second resistance and the second input of the first opamp is connect to a node between the first transistor and the second resistance;

a second diode connected between ground and the high voltage level, wherein the second diode is connected to the voltage level by a first and a second leg, wherein:

the first leg includes a second transistor whose gate is connected to receive the output of the first opamp; and the second leg includes a third transistor connected in series with a resistive voltage divider, where the resistive voltage divider is connected between the second diode and the third transistor; and a second opamp having an output connected to the gate of the third transistor, a first input connected to a node between the proportional to absolute temperature current source and the first resistance, and a second input connected to a node of the resistive voltage divider, wherein the reference voltage is provided from a node between the third transistor and the resistive voltage divider.

2. The circuit of claim 1, wherein the second diode is sized larger than the first diode.

3. The circuit of claim 2, wherein the ratio of sizes of the second diode to the first diode is approximately ten.

4. The circuit of claim 1, wherein the proportional to absolute temperature current source includes:

a fourth transistor connected between the first resistance and the high voltage level;

a fifth transistor connected between the high voltage level and a third resistor, and a third diode connected between the third resistor and ground; and a third opamp having a first input connected to a node between the fifth transistor and the third resistor, and second input connected to the node between the first diode and the first resistance, and having an output connected to the gates of the fourth and fifth transistors.

5. The circuit of claim 4, wherein the third diode is sized the same as the second diode.

* * * * *